US007581415B2

(12) United States Patent
Cesio Caccialli

(10) Patent No.: US 7,581,415 B2
(45) Date of Patent: Sep. 1, 2009

(54) APPARATUS FOR FEEDING AND DISCHARGING LIQUID CONTENTS IN A FULLING VAT FOR THE TREATMENT OF HIDES AND SKINS

(76) Inventor: Luis Cesio Caccialli, 8 de Octubre 4528, CP 12, 100, Montevideo (UY)

( * ) Notice: Subject to any disclaimer, the term of this patent is extended or adjusted under 35 U.S.C. 154(b) by 600 days.

(21) Appl. No.: 11/242,410

(22) Filed: Oct. 3, 2005

(65) Prior Publication Data

US 2006/0026999 A1 Feb. 9, 2006

Related U.S. Application Data

(63) Continuation-in-part of application No. 10/855,475, filed on May 27, 2004, now Pat. No. 7,461,526.

(30) Foreign Application Priority Data

Nov. 10, 2004 (UY) ..... U 4038

(51) Int. Cl.
*C14C 1/00* (2006.01)

(52) U.S. Cl. ..... 69/30

(58) Field of Classification Search ..... 69/29–32; 8/94.19 R, 94.2, 147, 150.5
See application file for complete search history.

(56) References Cited

U.S. PATENT DOCUMENTS

| | | | | | |
|---|---|---|---|---|---|
| 839,470 | A | * | 12/1906 | Glasel | 69/30 |
| 1,739,162 | A | * | 12/1929 | McKeon | 8/138 |
| 1,789,629 | A | * | 1/1931 | Kannel | 8/94.26 |
| 1,872,548 | A | * | 8/1932 | Zur Lowen | 8/147 |
| 2,180,562 | A | * | 11/1939 | Strobino | 8/150.5 |
| 2,653,075 | A | * | 9/1953 | Poser | 8/150.5 |
| 4,122,692 | A | * | 10/1978 | Dose | 69/30 |
| 4,441,342 | A | * | 4/1984 | Dose et al. | 69/30 |
| 5,346,101 | A | * | 9/1994 | Hargis et al. | 222/195 |

* cited by examiner

*Primary Examiner*—Shaun R Hurley

(57) ABSTRACT

A new mechanism for feeding and discharging liquid contents in fulling vats for the treatment of hides and skins, which is provided with internal and external ducts connected from outside the vat to crosspieces, said crosspieces having multiple orifices circular in shape and being provided at their ends with valves for the inflow and draining of liquid substances.

16 Claims, 2 Drawing Sheets

APPARATUS FOR FEEDING AND DISCHARGING LIQUID CONTENTS IN A FULLING VAT FOR THE TREATMENT OF HIDES AND SKINS

CROSS-REFERENCE TO RELATED APPLICATION

This is a continuation-in-part of U.S. patent application Ser. No. 10/855,475, filed on May 27, 2004, now U.S. Pat. No. 7,461,526, entitled "Spiral System Reactor for the Treatment of Hides and Skins," and claims priority to Uruguayan Patent Application No. U-4038 filed Nov. 10, 2004.

BACKGROUND OF THE INVENTION

The innovation claimed as patentable improves procedures for feeding and discharging liquids and solid chemicals in a process for the treatment of hides and skins carried out by using a fulling reactor suitable to that end.

SUMMARY OF THE INVENTION

The fulling vat or spiral system reactor which is referred to in this innovation carries out a mechanical process for the treatment of animal hides and skins (steeping, hair scraping, tanning, retanning, currying and other steps), and the course of said process involves the use of liquid feeds introduced through one end of the hollow shaft of the device. When the use of solid chemicals is required, said chemicals are usually introduced and drawn off through the same loading and unloading gate used for the hides and skins and are then gradually dissolved by the motion of the vat. Bearing in mind the fact that hides and skins are extremely sensitive to sudden changes or shifts in conditions (physical, thermal, hydric and tonic shocks), the invention provides for the use of hollow perforated crosspieces which reduce to a minimum the effects of shock, by the following means:

slow rotation, to prevent sudden blows or clashes;

thermostatic controls and regulators which prevent thermal shock;

perforated crosspieces which reduce to a minimum both hydric shock (occasional sudden pH variations) and tonic shock (variations in concentration).

The provision of perforated crosspieces offers not only the above advantages during the feeding step, but also ensures at the time of draining a faster drawing off of exhausted liquids (thus allowing for shorter "idle" time in the fulling vat).

Water and chemicals for the treatment of hides and skins flow into the reactor by means of valves placed at the side of the crosspieces, which have a great number of orifices. Likewise, water and chemicals are drawn off through said orifices, which act like a sprinkler facilitating a homogeneous distribution of treatment products, and also allow a faster drawing off of liquid after the process operations have been completed.

DETAILED DESCRIPTION

Figure 1:
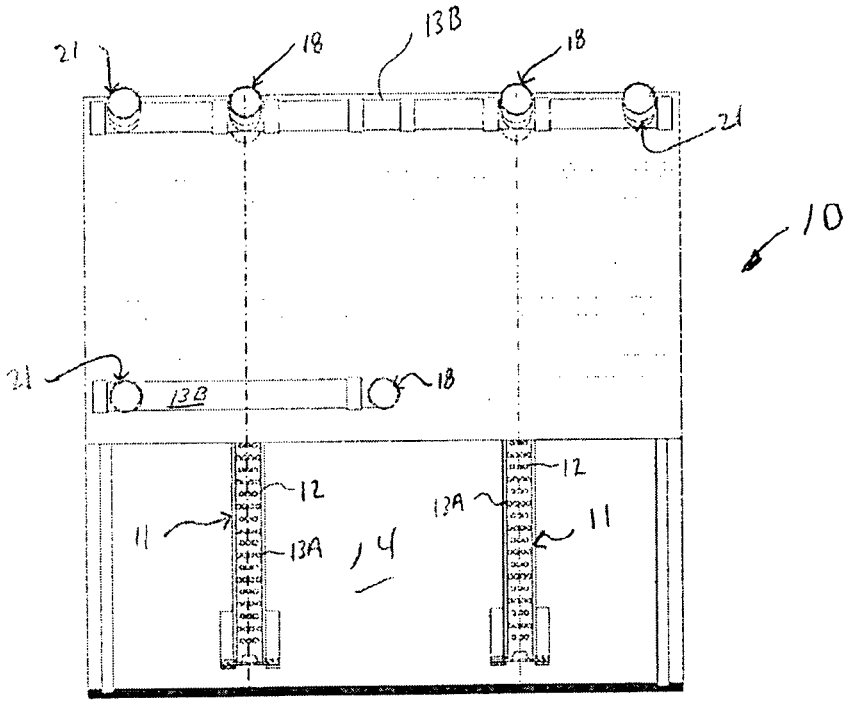
FIGS. 1 and 2 are side views in elevation of a vat in accordance with an example of the present invention.
Figure 2:
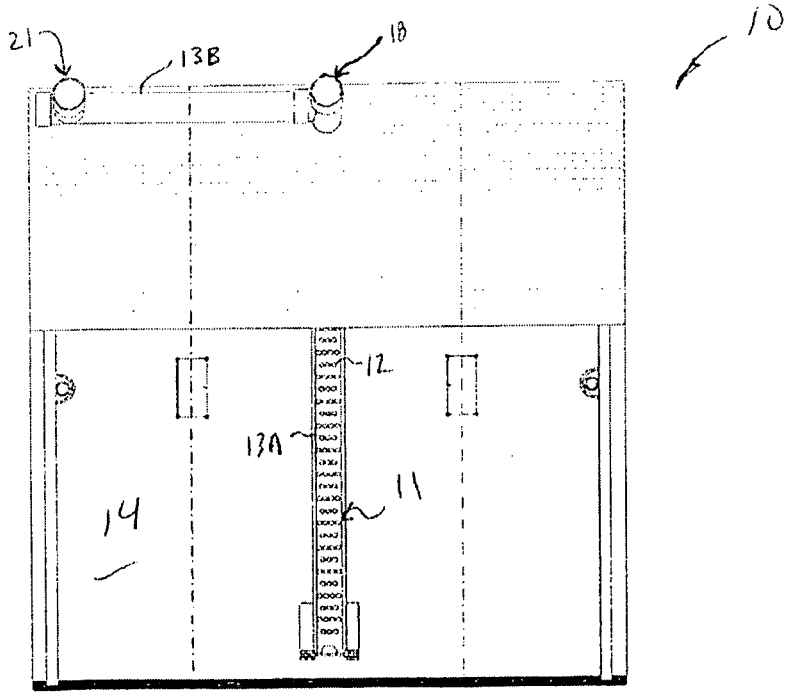
Figure 3:
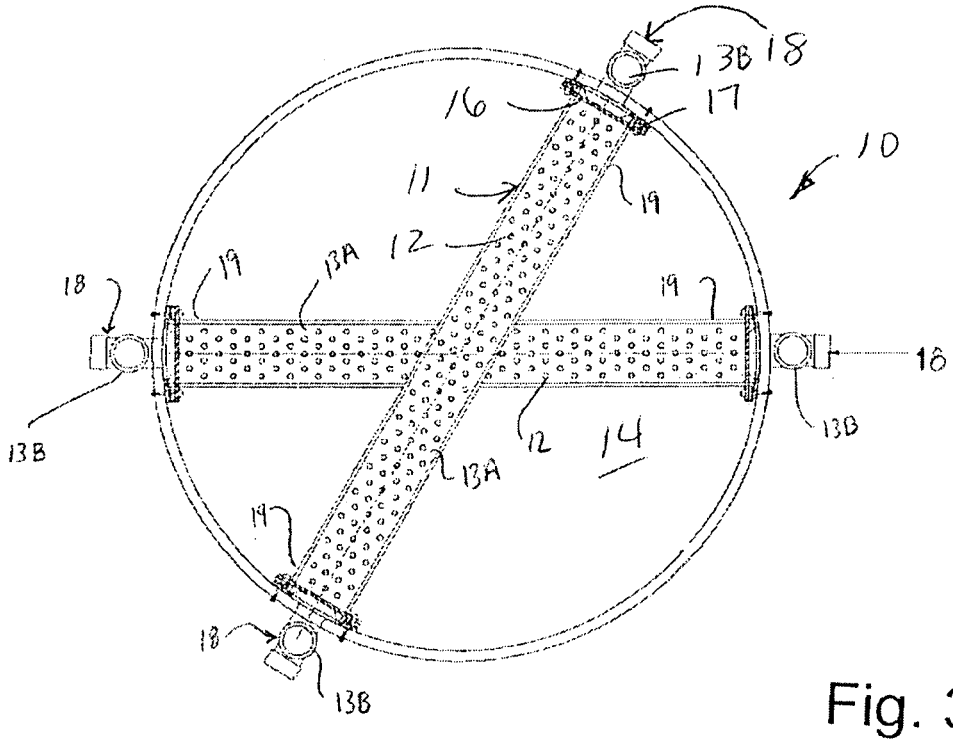
FIGS. 3 and 4 are transverse sectional views of the vat seen in FIG. 1.

As can be seen from FIGS. 1-4, which illustrate one embodiment of the invention, all crosspieces 11 set inside the fulling vat 10 have orifices 12 on their four sides, uniformly distributed and circular in shape. Mounting brackets 16 are located proximate the ends 19 of the crosspieces 11 and are engaged by fasteners 17 to couple the crosspieces 11 to and within the vat 10 (shown best in FIGS. 3-4). Background disclosure for this invention is provided by my copending U.S. patent application Ser. No. 10/855,475, including U.S. Pat. Pub. No. US2005/0034245, published Feb. 17, 2005, entitled "Spiral System Reactor for the Treatment of Hides and Skins," the disclosure of which is hereby incorporated by reference.

Figure 4:
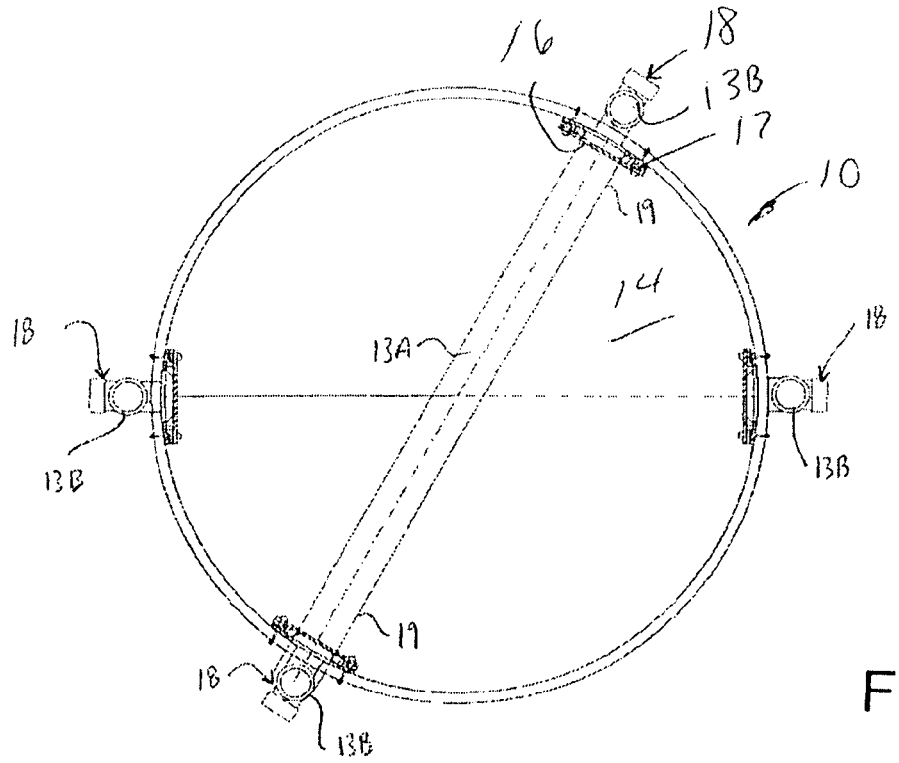

Liquids flow into the crosspieces 11 through inner ducts 13A (defined generally by the crosspiece 11 as shown in FIG. 4 with a portion of the crosspiece 11 hidden for clarity) and external ducts 13B connected thereto, and through said crosspieces 11 are poured into a chamber 14 in the vat 10 through the orifices 12. In the opposite case, when the active process has been completed by the device, liquids are drawn off into the crosspieces 11 through said orifices 12, and each crosspiece 11 is provided at its end 19 with a valve 18 connected to an external duct 13B which in turn leads to an external valve 21 for final draining.

I claim:

1. An apparatus for feeding and discharging liquid contents for treatment of hides and skins, the apparatus comprising:

a chamber defining an interior surface;

a crosspiece within the chamber having a first end and a second end operatively coupled to the interior surface of the chamber;

an inner duct defined within the crosspiece;

a plurality of orifices formed in the crosspiece in fluid communication with the inner duct; and an external duct outside of the chamber in fluid communication with the inner duct;

wherein the liquid contents selectively flows through the plurality of orifices, the inner duct, and the external duct during a feeding and a discharging of the liquid contents into and from the chamber.

2. The apparatus of claim 1, wherein the plurality of orifices are essentially circular.

3. The apparatus of claim 2, wherein the plurality of orifices are essentially uniformly spaced apart along the crosspiece.

4. The apparatus of claim 1, further comprising:

a second crosspiece having a second inner duct defined within the second crosspiece;

wherein the inner duct of the crosspiece and the second inner duct of the second crosspiece are in fluid communication with the external duct.

5. The apparatus of claim 1, further comprising a valve operatively coupled to the crosspiece proximate the first end of the crosspiece to control flow of the liquid contents between the inner duct and the external duct.

6. The apparatus of claim 5, further comprising a second valve operatively coupled to the second end of the crosspiece opposite the first end of the crosspiece.

7. The apparatus of claim 1, wherein the crosspiece includes four sides.

8. The apparatus of claim 7, wherein the plurality of orifices are formed in each of the four sides.

9. An apparatus for feeding and discharging liquid contents for treatment of hides and skins, comprising:

a chamber defining an interior surface and a pair of end walls;

a plurality of crosspieces within the chamber each having a first end and a second end coupled to at least one of the interior surface and the pair of end walls;

an inner duct defined within each of the plurality of crosspieces;

a plurality of orifices formed in each of the plurality of crosspieces in fluid communication with the inner duct of each of the plurality of crosspieces; and at least one external duct outside of the chamber in fluid communication with the inner ducts of at least a pair of the plurality of crosspieces;

wherein the liquid contents flows through the external duct and the inner ducts of the at least a pair of the plurality of crosspieces during a feeding and a discharging of the liquid contents into and from the chamber.

10. The apparatus of claim 9, wherein the plurality of orifices are essentially circular and are essentially uniformly spaced apart along the plurality of crosspieces.

11. The apparatus of claim 9, wherein a valve is operatively coupled to the first end of each of the at least a pair of the plurality of crosspieces to control flow of the liquid contents between the inner duct defined within each of the at least a pair of the plurality of crosspieces and the at least one external duct.

12. The apparatus of claim 11, wherein a second valve is operatively coupled to the second end of each of the at least a pair of the plurality of crosspieces.

13. An apparatus for feeding and discharging liquid contents for treatment of hides and skins, the apparatus comprising:

a chamber;

a first crosspiece operatively coupled within the chamber proximate at least one of a first end and a second end of the first crosspiece;

a first inner duct defined within the first crosspiece;

a first plurality of orifices formed in the first crosspiece in fluid communication with the first inner duct;

a second crosspiece operatively coupled within the chamber proximate at least one of a first end and a second end of the second crosspiece;

a second inner duct defined within the second crosspiece;

a second plurality of orifices formed in the second crosspiece in fluid communication with the second inner duct; and an external duct outside of the chamber proximate at least one of the first end and the second end of the first crosspiece and at least one of the first end and the second end of the second crosspiece, such that a first connection establishing fluid communication between the first inner duct and the external duct and a second connection establishing fluid communication between the second inner duct and the external duct are positioned outside of the chamber.

14. The apparatus of claim 13, further comprising a first valve operatively coupled to at least one of the first end and the second end of the first crosspiece to selectively control fluid communication between the first inner duct and the external duct.

15. The apparatus of claim 14, further comprising a second valve operatively coupled to at least one of the first end and the second end of the second crosspiece to selectively control fluid communication between the second inner duct and the external duct.

16. The apparatus of claim 15, wherein:

the first plurality of orifices are essentially circular and are essentially uniformly spaced apart along first crosspiece; and the second plurality of orifices are essentially circular and are essentially uniformly spaced apart along second crosspiece.

* * * * *

UNITED STATES PATENT AND TRADEMARK OFFICE

CERTIFICATE OF CORRECTION

PATENT NO. : 7,581,415 B2
APPLICATION NO. : 11/242410
DATED : September 1, 2009
INVENTOR(S) : Luis Cesio Caccialli It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 933 days.

Signed and Sealed this

Fourteenth Day of September, 2010

David J. Kappos

David J. Kappos
*Director of the United States Patent and Trademark Office*